US010196242B2

(12) United States Patent
Moran et al.

(10) Patent No.: US 10,196,242 B2
(45) Date of Patent: Feb. 5, 2019

(54) CRANE TROLLEY AND HOIST POSITION HOMING AND VELOCITY SYNCHRONIZATION

(71) Applicant: Mi-Jack Products, Inc., Hazel Crest, IL (US)

(72) Inventors: Matthew M. Moran, Woodridge, IL (US); Steven Pfeifenroth, Chicago, IL (US)

(73) Assignee: Mi-Jack Products, Inc., Hazel Crest, IL (US)

( * ) Notice: Subject to any disclaimer, the term of this patent is extended or adjusted under 35 U.S.C. 154(b) by 269 days.

(21) Appl. No.: 15/076,934

(22) Filed: Mar. 22, 2016

(65) Prior Publication Data

US 2016/0200554 A1 Jul. 14, 2016

Related U.S. Application Data

(62) Division of application No. 14/158,538, filed on Jan. 17, 2014, now Pat. No. 9,321,614.

(51) Int. Cl.

| | |
|---|---|
| ***B66C 13/22*** | (2006.01) |
| ***B66C 19/00*** | (2006.01) |
| ***B66C 13/06*** | (2006.01) |

(52) U.S. Cl.

CPC ..... *B66C 13/22* (2013.01); *B66C 13/063* (2013.01); *B66C 19/005* (2013.01); *B66C 19/007* (2013.01)

(58) Field of Classification Search

CPC ..... B66C 13/00; B66C 13/04; B66C 13/06; B66C 13/063; B66C 13/18; B66C 13/22; B66C 19/00; B66C 19/005; B66C 19/007

See application file for complete search history.

(56) References Cited

U.S. PATENT DOCUMENTS

| | | | | |
|---|---|---|---|---|
| 3,533,425 | A | 10/1970 | Hannan | |
| 4,135,628 | A | 1/1979 | Harris et al. | |
| 4,358,020 | A | 11/1982 | Thiele | |
| 4,544,070 | A | 10/1985 | Sickler | |
| 4,546,891 | A | 10/1985 | Lanigan, Sr. et al. | |
| 4,667,834 | A | 5/1987 | Lanigan et al. | |
| 4,997,095 | A | 3/1991 | Jones et al. | |
| 5,180,070 | A * | 1/1993 | Feider | B62D 7/026 180/415 |
| 5,526,946 | A | 6/1996 | Overton | |
| 5,570,986 | A | 11/1996 | Hasegawa et al. | |
| 5,713,477 | A | 2/1998 | Wallace, Jr. et al. | |

(Continued)

*Primary Examiner* — Emmanuel M Marcelo

*Assistant Examiner* — Juan J Campos, Jr.

(74) *Attorney, Agent, or Firm* — McCracken & Gillen LLC

(57) ABSTRACT

A method of transferring a load is disclosed. The method includes the steps of enabling synchronization of first and second hoists and first and second trolleys and choosing a hoist function or a trolley function. The first and second hoists are a first mover and second mover, if the hoist function is selected. The first and second trolleys are the first and second movers, if the trolley function is selected. The method includes the steps of commanding one of the first mover and second mover to be the master and the other to be the slave and actuating a master control associated with the master. The method further includes the step of outputting signals to the first and second actuators such that the master and the slave are moved in a direction indicated by the master control.

11 Claims, 14 Drawing Sheets

(56) References Cited

U.S. PATENT DOCUMENTS

| | | | | |
|---|---|---|---|---|
| 5,715,958 | A | 2/1998 | Feider et al. | |
| 5,754,672 | A | 5/1998 | Monzen et al. | |
| 5,785,191 | A | 7/1998 | Feddema et al. | |
| 5,806,696 | A | 9/1998 | Hytonen | |
| 5,823,369 | A | 10/1998 | Kuromoto | |
| 5,893,471 | A | 4/1999 | Zakula | |
| 5,909,817 | A | 6/1999 | Wallace, Jr. et al. | |
| 6,081,292 | A * | 6/2000 | Lanigan, Jr. ..... | B66C 13/46 114/264 |
| 6,135,301 | A | 10/2000 | Monzen et al. | |
| 6,250,486 | B1 | 6/2001 | Enoki | |
| 6,460,711 | B1 | 10/2002 | Kato et al. | |
| 6,588,610 | B2 | 7/2003 | Ong et al. | |
| 6,962,091 | B2 | 11/2005 | Lukas | |
| 7,150,366 | B1 | 12/2006 | Zakula, Sr. et al. | |
| 7,289,875 | B2 | 10/2007 | Recktenwald et al. | |
| 7,451,883 | B2 | 11/2008 | Wierzba et al. | |
| 7,546,929 | B2 | 6/2009 | Wierzba et al. | |
| 7,648,036 | B2 | 1/2010 | Recktenwald et al. | |
| 8,127,950 | B2 | 3/2012 | Glickman et al. | |
| 8,235,229 | B2 | 8/2012 | Singhose et al. | |
| 2005/0103738 | A1 | 5/2005 | Recktenwald et al. | |
| 2005/0242052 | A1 | 11/2005 | O'Connor et al. | |
| 2007/0095776 | A1* | 5/2007 | Wierzba ..... | B66C 13/18 212/344 |
| 2011/0147330 | A1 | 6/2011 | Glickman et al. | |
| 2011/0272376 | A1 | 11/2011 | Jung et al. | |
| 2012/0168397 | A1 | 7/2012 | Lim et al. | |
| 2014/0224755 | A1 | 8/2014 | Eriksson et al. | |
| 2015/0012188 | A1 | 1/2015 | Scheider et al. | |

* cited by examiner

CRANE TROLLEY AND HOIST POSITION HOMING AND VELOCITY SYNCHRONIZATION

CROSS REFERENCE TO RELATED APPLICATIONS

This divisional patent application claims the benefit of U.S. patent application Ser. No. 14/158,538, filed Jan. 17, 2014, and titled Crane Trolley and Hoist Position Homing and Velocity Synchronization, the contents of which is incorporated herein by reference.

REFERENCE REGARDING FEDERALLY SPONSORED RESEARCH OR DEVELOPMENT

Not applicable

SEQUENTIAL LISTING

Not applicable

BACKGROUND

1. Field of the Invention

This invention relates to crane control systems in general, and specifically to a synchronization system for level-beam, cantilever and overhead gantry cranes having a hoist suspended from a trolley for lifting a load and a trolley for transporting the load laterally along one or more beams associated with the crane.

2. Description of the Background

Level-beam, cantilever cranes and overhead gantry cranes such as Rail-Mounted Gantry cranes ("RMG") and Rubber Tire Gantry cranes ("RTG"), are used to move loads of varying size and weight from one location to another. Often cranes such as the RTG crane shown in FIG. 1 include one or more trolleys and hoists, which are used to move large, heavy loads. Due to a variety of factors such as uneven load weight, wind, crane motion, and the acceleration and deceleration of the trolley, loads tend to sway or swing during movement. Load sway is problematic because loading and unloading operations cannot take place if the load is swaying at the end of movement. If a load is swaying at the end of movement, an operator must either wait for the load to stop swaying or maneuver the trolley and/or hoists in a manner that negates the swaying movement. This waiting and/or maneuvering can take up to one third or more of the total transfer time.

Several anti-sway systems have been developed to counteract the sway of loads during movement. One such system is disclosed in Overton, U.S. Pat. No. 5,526,946. The anti-system system disclosed in Overton uses a double-pulse, anti-sway algorithm that is based on a single pendulum length to negate the affects of sway caused by acceleration of the trolley, movement of the hoists, and external factors.

However, not all sway movement is in the form of a single pendulum as shown in FIGS. 2 and 2A. Often time uneven hoists or misaligned trolleys cause sway that has a circular motion, which is difficult to control, rather than a single pendulum-type motion. For example, FIGS. 3 and 3A show an example of one type of a circular sway caused by misaligned front and rear trolleys. In this example, all the hoists are even, i.e., at the same height, but the front and rear trolleys are misaligned, i.e., the front and rear trolleys are not square with the beams of the crane. Likewise, FIGS. 4 and 4A illustrate an example of a circular sway that is caused by uneven hoists. Here, the trolleys are properly aligned but the hoists are not even.

To address the problem of uneven hoists and misaligned trolleys, an operator must skillfully synchronize all the hoists and trolleys using multiple independent controls, which is time consuming and imperfect. Other methods for control require mechanical bridges that replace or are connected to the trolleys and hoists in order to mechanically synchronize them. Such devices are very expensive, and therefore not practical to implement.

Given the limitations of the prior art, there exists a need for a single control for all trolleys and a single control for all hoists so that synchronization of the trolleys and hoists can be obtained quickly and efficiently. By synchronizing the trolleys and hoists, uncontrollable swing of the lifted load will be greatly reduced, thereby improving productivity, increasing safety, and reducing operator fatigue.

It would also be an improvement in the art to enable synchronization of the trolleys and hoists so that anti-sway technology can be used to eliminate further load sway during lateral movement of the load.

SUMMARY

Disclosed is a method of transferring a load using a transport device. The transport device has a first hoist and a second hoist and a first trolley and a second trolley. The first hoist is connected to the first trolley and the second hoist is connected to the second trolley. The method includes the step of enabling synchronization of the first and second hoists and the first and second trolleys. Synchronization includes the steps of leveling the first and second hoists and squaring the first and second trolleys. The method also includes the step of choosing one of a hoist function and a trolley function. If the hoist function is selected, the first and second hoists are a first mover and second mover, respectively; and if the trolley function is selected the first and second trolleys are the first and second movers, respectively. The method further includes the step of commanding one of the first mover and the second mover to be the master and the other mover to be the slave. The master is connected to a first actuator and the slave is connected to a second actuator. The method includes the steps of actuating a master control associated with the master and outputting a signal to the first and second actuators such that the first actuator moves the master and the second actuator moves the slave in a direction indicated by the master control.

Other aspects and advantages of the disclosed method and system will become apparent upon consideration of the following detailed description.

DETAILED DESCRIPTION

As used herein, the terms first, second, third and the like are used to distinguish between similar elements and not necessarily for describing a specific sequential or chronological order. The terms are interchangeable under appropriate circumstances and the embodiments of the invention can operate in other sequences than described or illustrated herein.

In addition, the terms top, bottom, front, rear, left, right and the like as used herein are used for descriptive purposes and not necessarily for describing specific positions. The terms so used are interchangeable under appropriate circumstances and the embodiments of the invention described herein can operate in other orientations than describe or illustrated herein.

Figure 1:
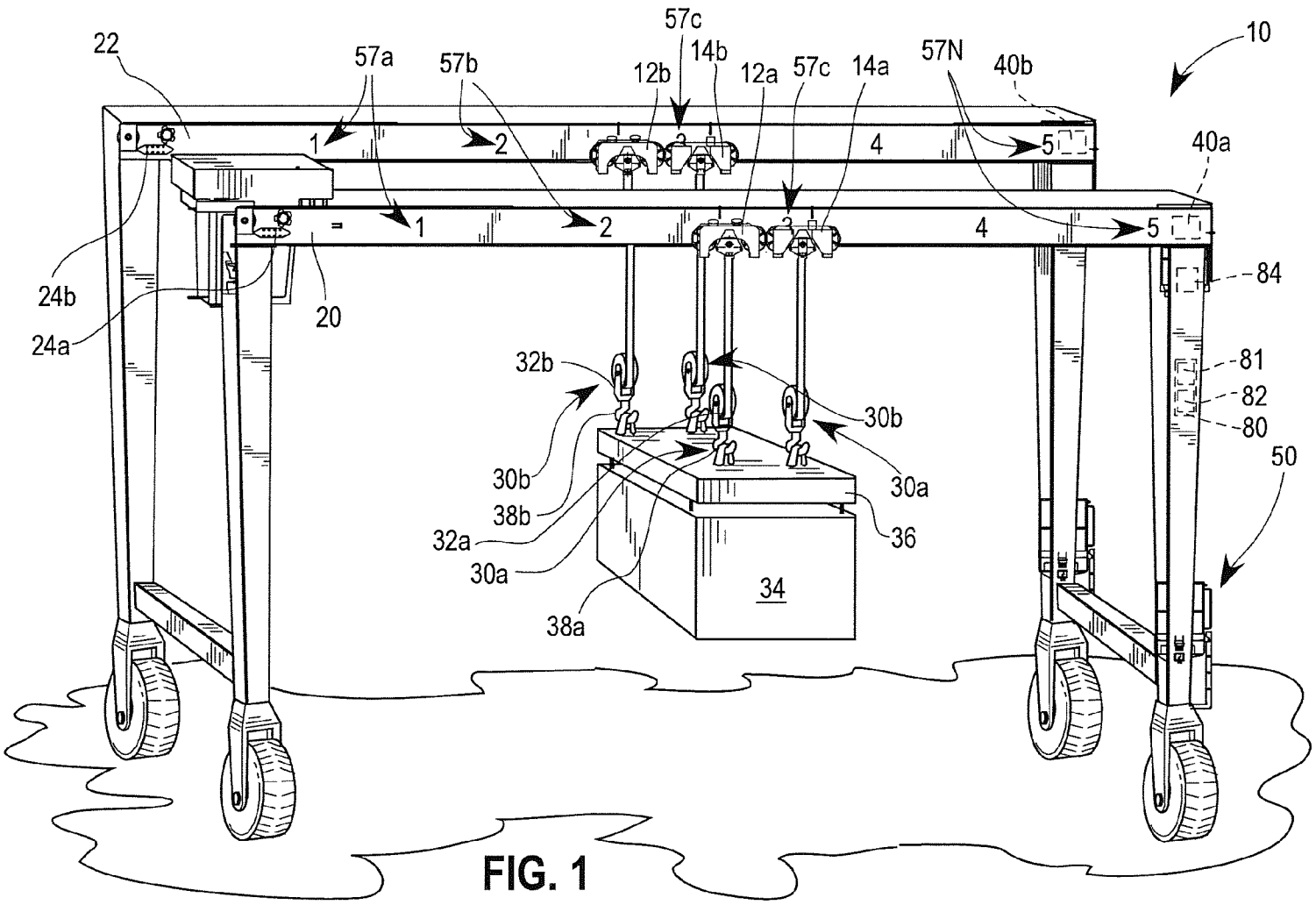
FIG. 1 is a trimetric view of one embodiment of a crane.

FIG. 1 shows one embodiment of a level-beam gantry crane 10. The crane 10 of FIG. 1 includes a front top beam 20 and a rear top beam 22. A first front trolley 12*a* and a second front trolley 14*a* are moveably mounted on the front top beam 20, and a first rear trolley 12*b* and a second rear trolley 14*b* are moveably mounted on the rear top beam 22. Although in FIG. 1 only two front trolleys 12*a*, 14*a* are shown on the front top beam 20 of the crane 10 and two rear trolleys 12*b*, 14*b* are shown on the rear top beam 22, any number of trolleys (e.g., three, four, five, etc.) may be disposed on the top beams 20, 22 of crane 10. The first and second front trolleys 12*a* and 14*a*, respectively, are connected to a front trolley actuator 24*a*. The front trolley actuator 24*a* may be mounted on the front top beam 20 and controls the lateral movement of front trolleys 12*a*, 14*a* along the front top beam 20. Likewise, the first and second rear trolleys 12*b* and 14*b*, respectively, are connected to a rear trolley actuator 24*b*. The rear trolley actuator 24*b* may be mounted on the rear top beam 22 and controls the lateral movement of rear trolleys 12*b*, 14*b* along the rear top beam 22. Although a single trolley actuator (i.e., 24*a* and 24*b*) is shown on each of the front and rear top beams 20, 22 in FIG. 1, individual actuators for each trolley may also be used within the scope and intent of this invention (e.g., trolley actuators 24*a*, 24*b*, 26*a*, and 26*b* may each be used for a trolley). In the illustrative example shown in FIG. 1, the trolley actuators 24*a*, 24*b* are hydraulic motors. Other actuators such as electric motors, hydraulic cylinders, electric linear actuators, or other suitable means may be used within the scope and intent of this invention for producing trolley motion along the top beams 20, 22 of the crane 10.

Figure 1A:
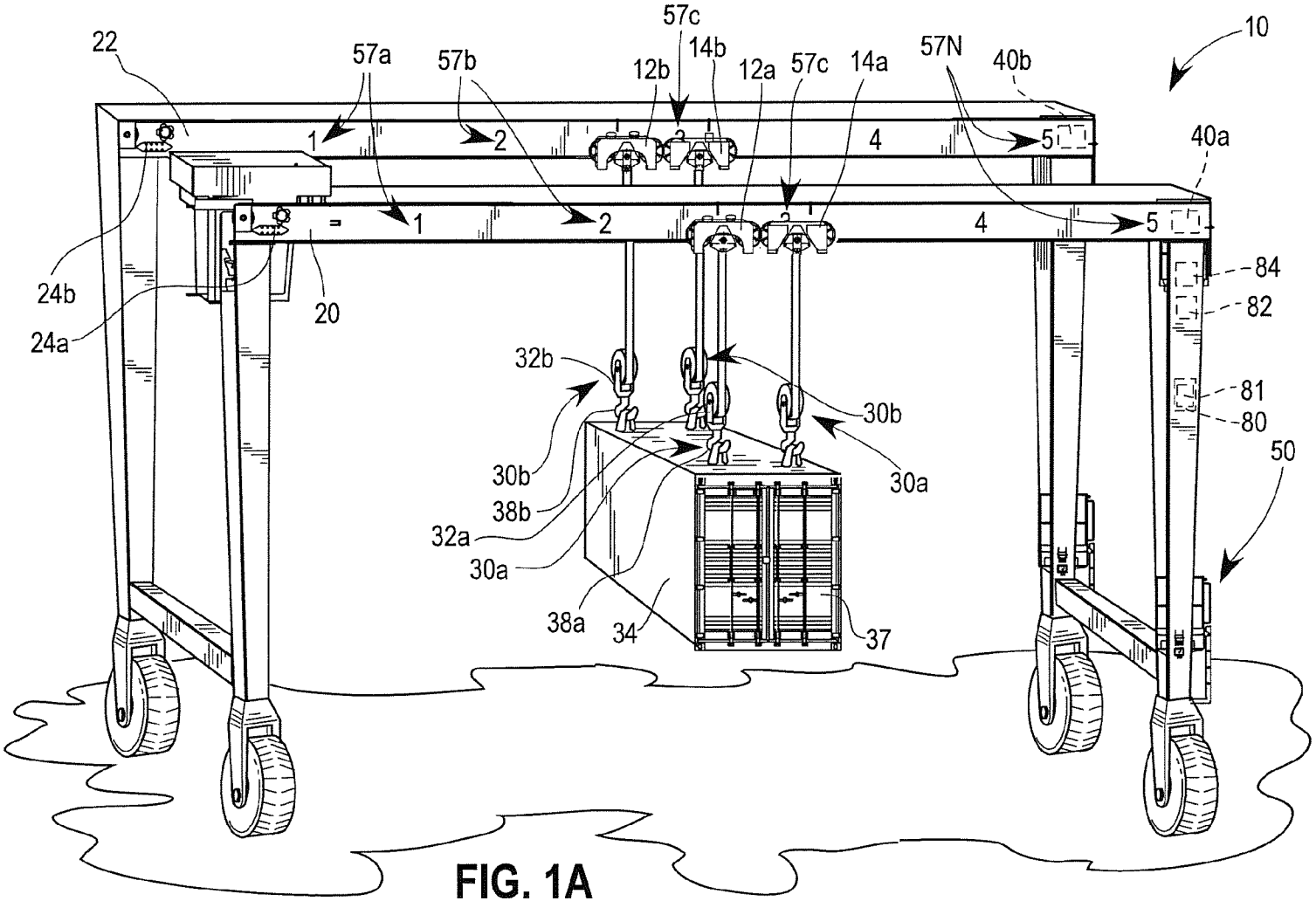
FIG. 1A is a trimetric view of another embodiment of the crane of FIG. 1.

Attached to and vertically suspended from the first and second front trolleys 12*a* and 14*a*, respectively, are front hoist members 30*a*. The front hoist members 30*a* each include a hoist sheave block 32*a* and a hook block 38*a*, which is connected to the sheave block 32*a*. Similarly, attached to and vertically suspended from the first and second rear trolleys 12*b* and 14*b*, respectively, are rear hoist members 30*b*. The rear hoist members 30*b* each include a hoist sheave block 32*b* and a hook block 38*b*, which is attached to the sheave block 32*b*. As shown in FIG. 1, the hook blocks 38*a*, 38*b* engage a spreader 36, which is used to raise and lower a load 34 such as a shipping container 37 (see FIG. 1A), precast concrete, steel, and/or other large objects. Alternatively, the hook blocks 38*a*, 38*b* may be attached directly to the load 34, for example the container 37 of FIG. 1A, when suitable lift points are employed on the load 34. In the illustrative embodiment of FIG. 1, the front hoist members 30*a* are connected to and suspended from a front hoist actuator 40*a* and the rear hoist members 30*b* are connected to and suspended from a rear hoist actuator 40*b*. In this embodiment, the front hoist actuator 40*a* lifts and lowers the front hoist members 30*a*, and the rear hoist actuator 40*b* lifts and lowers the rear hoist members 30*b*. Although two hoist actuators 40*a*, 40*b* are shown in FIG. 1, multiple hoist actuators (e.g., three, four, five, etc.), each controlling individual hoist members or multiple hoist members may be used (e.g., hoist actuators 40*a*, 40*b*, 41*a*, and 41*b* maybe each be used for a hoist member). The front and rear hoist actuators 40*a* and 40*b*, respectively, may be drum and wire rope devices as known in the art, and may be driven by hydraulic motors, electric motors, or other suitable means within the scope and intent of the invention.

Figure 5:
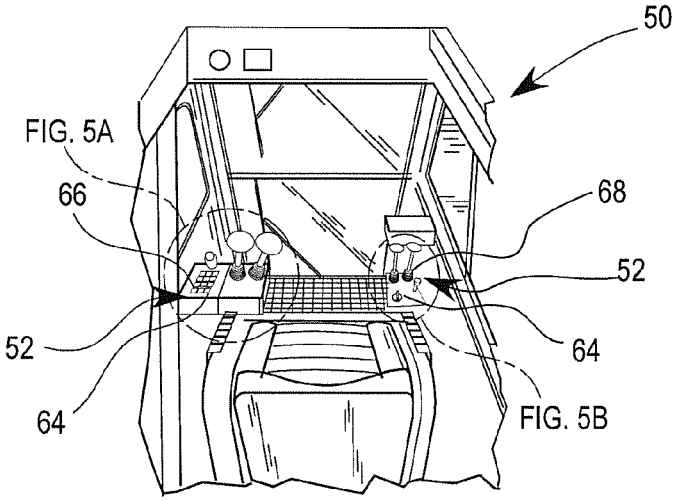
FIG. 5 is a partial perspective view of the interior of an operator control station associated with the crane of FIG. 1.
Figure 5A:
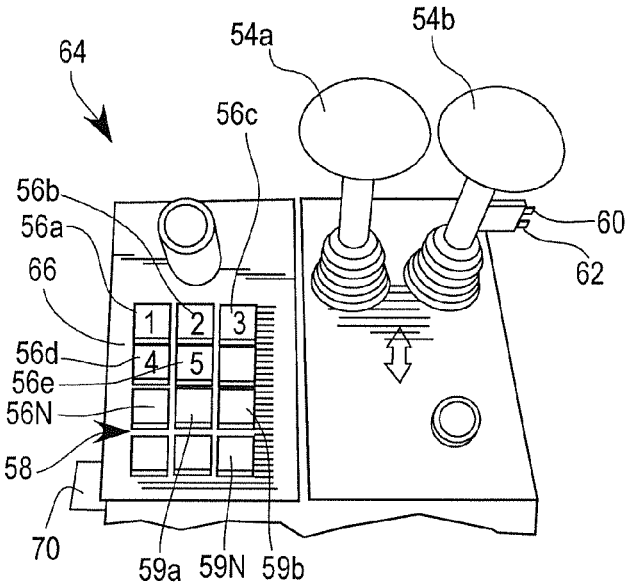
FIG. 5A is a partial perspective view of a left control console of the operator control station of FIG. 5.
Figure 5B:
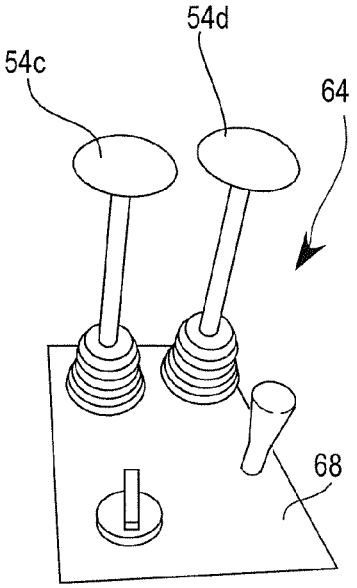
FIG. 5B is a partial perspective view of a right control console of the operator control station of FIG. 5.

The crane 10 may have a control station 50 disposed on or adjacent to the crane 10. Turning to FIGS. 5-5B, the control station 50 may include multiple controls mechanisms 52. The control mechanisms 52 may include controls 54 for the hoist members 30*a*, 30*b* and the trolleys 12*a*, 12*b*, 14*a*, 14*b* such as joysticks 54*a*, 54*b*, 54*c*, and 54*d* (FIGS. 5A and 5B), a key pad 58 (FIG. 5A), a synchronization button 60 (FIG. 5A), and a suspend button 62 (FIG. 5A). The controls 54 may be disposed on one control console 64 or they may be disposed on multiple control consoles 64. For example, the controls 54*a*, 54*b* may be disposed on a left console 66 and controls 54*c*, 54*d* may be disposed on a right console 68 as shown in FIGS. 5A and 5B. Alternatively, the control consoles 64 may be presented virtually on a computer display (not shown). An indicator mechanism 70 may also be included on the left console 66 (see FIG. 5A) or the right console 68, or anywhere in the control station 50 where the operator can see, hear, or feel the signal generated by the indicator mechanism 70.

Each control 54*a*, 54*b*, 54*c*, 54*d* may be associated with one or more of the front trolleys 12*a*, 14*a*, the rear trolleys 12*b*, 14*b*, the front hoist members 30*a*, and the rear hoist members 30*b*. In the illustrative example, there are four controls, a front trolley control 54*a*, a rear trolley control 54*b*, a front hoist control 54*c*, and a rear hoist control 54*d*. In the illustrative example, the front trolley control 54*a* is electrically connected to the first and second front trolleys

12*a* and 14*a*, respectively, via the front trolley actuator 24*a* and is used to direct lateral movement of the front trolleys 12*a*, 14*a*. Likewise, the rear trolley control 54*b* is electronically connected to the first and second rear trolleys 12*b* and 14*b*, respectively, via rear trolley actuator 24*b* and is used to direct lateral movement of the rear trolleys 12*b*, 14*b*. The front hoist control 54*c* is electronically connected to the front hoist members 30*a* via the front hoist actuator 40*a* and directs the front hoist members 30*a* to move substantially in a vertical, up or down direction. The rear hoist control 54*d* is electronically connected to the rear hoist members 30*b* via the rear hoist actuator 40*b* and directs the rear hoist members 30*b* to move substantially in a vertical, up or down direction.

The key pad 58 may include any number of automatic trolley controls 56*a*, 56*b*, . . . , 56N that have one or more functions assigned to each control. The controls may be associated, for example, with any number or combinations of pre-set locations 57 located incrementally along the front top beam 20 and the rear top beam 22 of the crane 10, as shown in FIG. 1. In the illustrative example, the key pad 58 has five buttons 56*a*, 56*b*, 56*c*, 56*d*, and 56*e*, which are labeled "1", "2", "3", "4", and "5", respectively. Each of the five numbered buttons, in the illustrative example, is associated with a single pre-set location 57 on the top beams 20 and 22; therefore, there are five pre-set locations 57 disposed on both the front top beam 20 and the rear top beam 22 as shown in FIG. 1. Each of the pre-set locations 57 on the front top beam 20 corresponds to a pre-set location 57 on the rear top beam 22. In the illustrative example, the first pre-set location 57*a* on front top beam 20, which is indicated by the number "1", is located at the same point on the beam as the first pre-set location 57*a* of the rear top beam 22, which is also indicated by the number "1". The second pre-set location 57*b* on the front top beam 20, which is indicated by the number "2", is located at the same point on the beam as the second pre-set location 57*b* of the rear top beam 22, which is also indicated by the number "2", and so on. To move the trolleys to the first pre-set location 57*a* on the top beams 20, 22, an operator would activate, for example, the button labeled "1". To move the trolleys to the second pre-set location 57*b* on the top beams 20, 22, then the operator would activate the button labeled "2." To move the trolleys to the third pre-set location 57*c* on the top beams 20, 22, the operator would activate the button labeled "3" and so on.

The key pad 58 may also contain one or more automatic hoist controls 59*a*, 59*b*, . . . , 59N for moving the hoist members 30*a* and 30*b* to one or more pre-set hoist positions. For example, the pre-set hoist position may be a position that is located proximate the front trolleys 12*a*, 14*a* or rear trolleys 12*b*, 14*b* and associated with a button 59*a*. In the illustrative example, when the button 59*a* is actuated, the hoist members 30*a*, 30*b* move the load 34 toward the top beams 20, 22 and then stop moving when the load 34 reaches the top beams 20, 22. Alternately, the pre-set hoist position may be a position distal to the front or rear trolleys and associated with a button 59*b*. In the illustrative example, when the button 59*b* is activated, the hoist members 30*a*, 30*b* move the load downward, away from the top beams 20, 22 to a position located at a set distance from the top beams 20, 22. The functions of the automatic trolley and hoist controls 56 and 59, respectively, located on the key pad 58 may be used individually or together and may be used in a manual or synchronized mode (see discussion below).

Turning to FIGS. 6A and 6B and FIGS. 7A and 7B, a method 100 and system 200 of transferring the load 34 are shown. At a step 101, a synchronization module 81 of a program logic controller ("PLC") 80 is enabled. Because PLCs are well-known in the art, further detail regarding such devices is not provided herein. The synchronization module 81 is activated by actuating the synchronization button 60. Although the synchronization button 60 is shown as a physical button disposed on the rear trolley control 54*b*, the synchronization button 60 may be disposed on any one of controls 54*a*, 54*b*, 54*c*, and 54*d*, the key pad 58, or any other location that is convenient for an operator. The synchronization button 60 may also be a virtual button that is displayed on a virtual control console (not shown).

Figure 2:
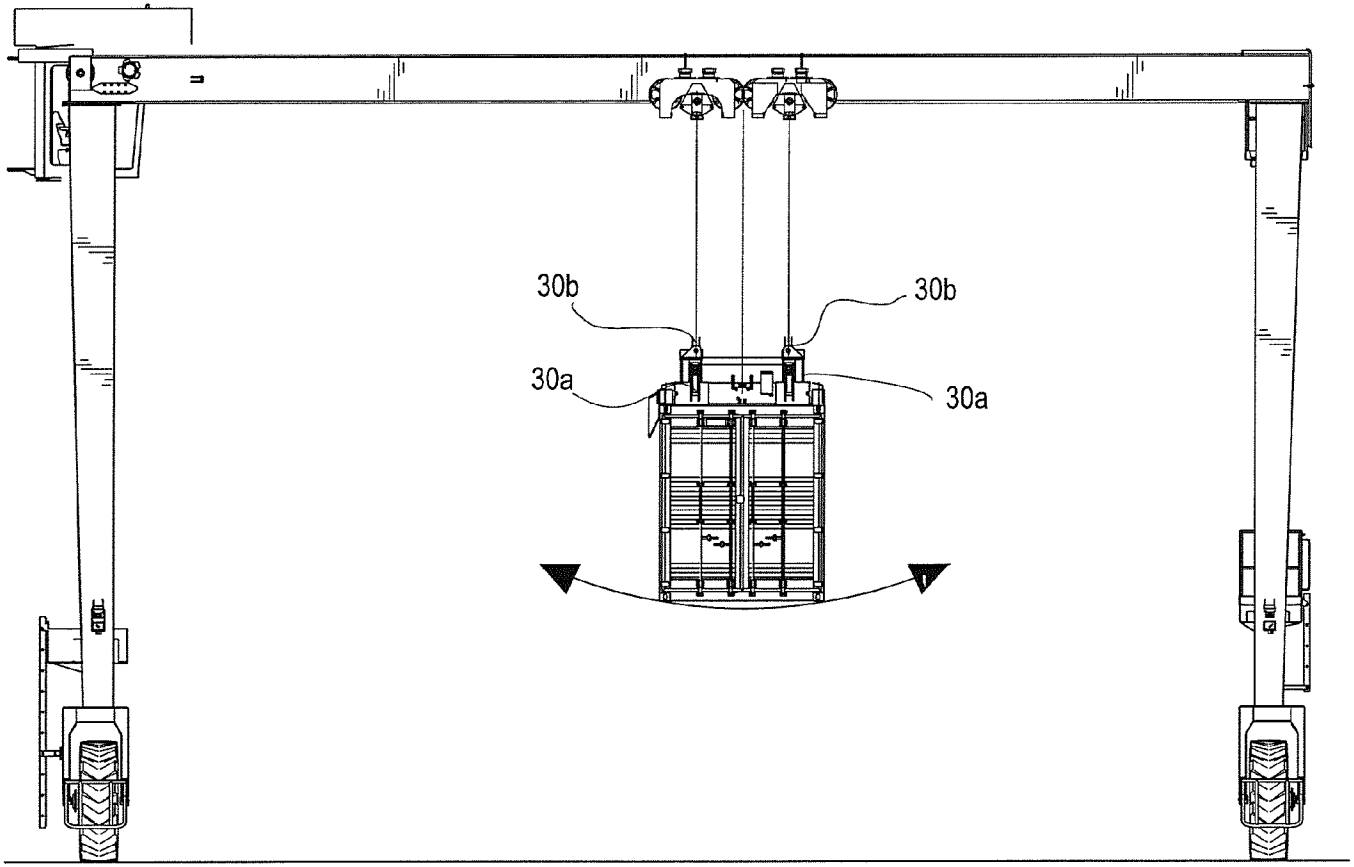
FIG. 2 is a front elevational view of another embodiment of the crane of FIG. 1 with a load attached to multiple hoists suspended from trolleys disposed on the top beams of the crane, illustrating the single-pendulum swinging direction of the load when the hoists are level and the trolleys are square with the top beams.
Figure 2A:
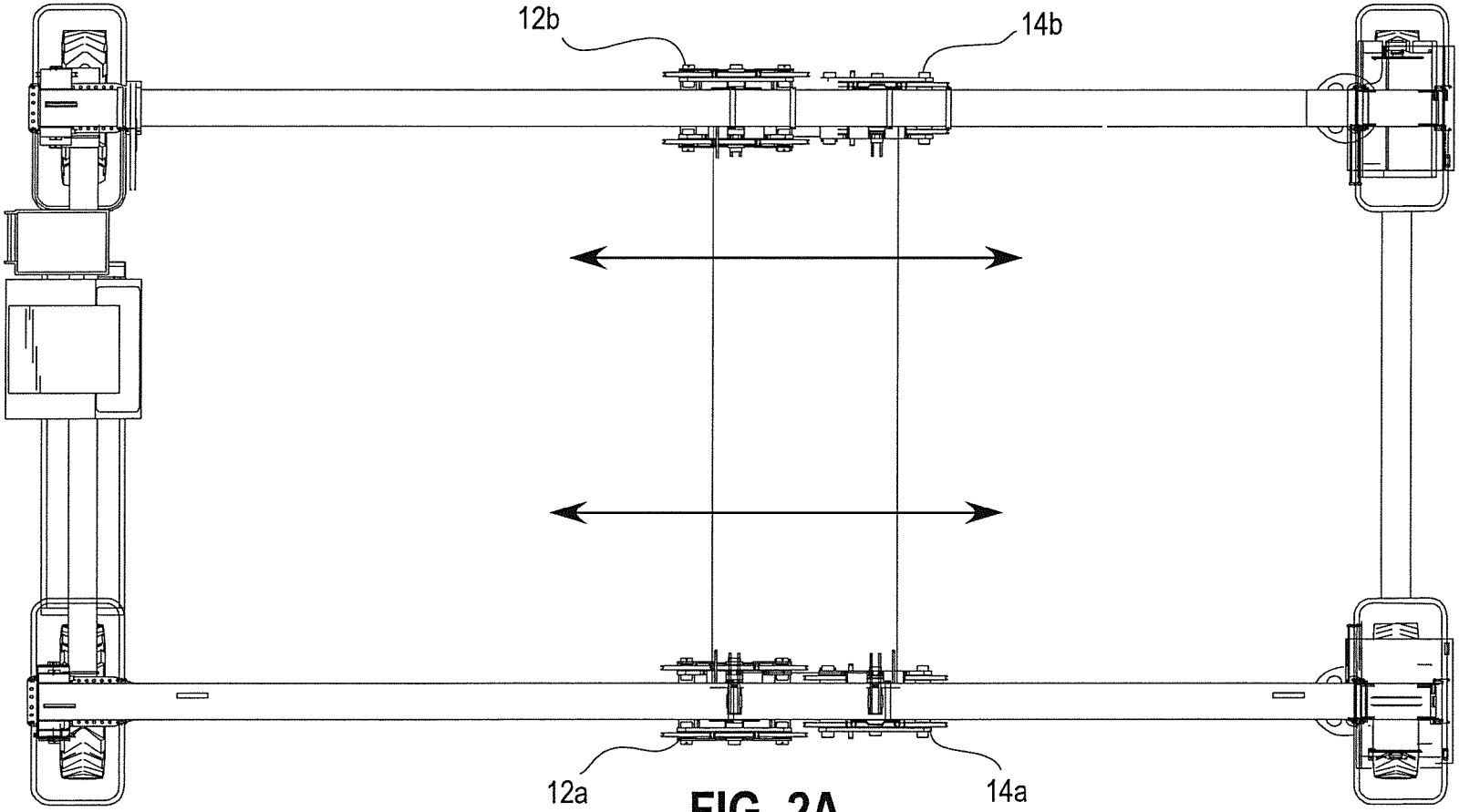
FIG. 2A is a diagrammatic plan view of the crane of FIG. 2, illustrating the swinging direction of the load.
Figure 3:
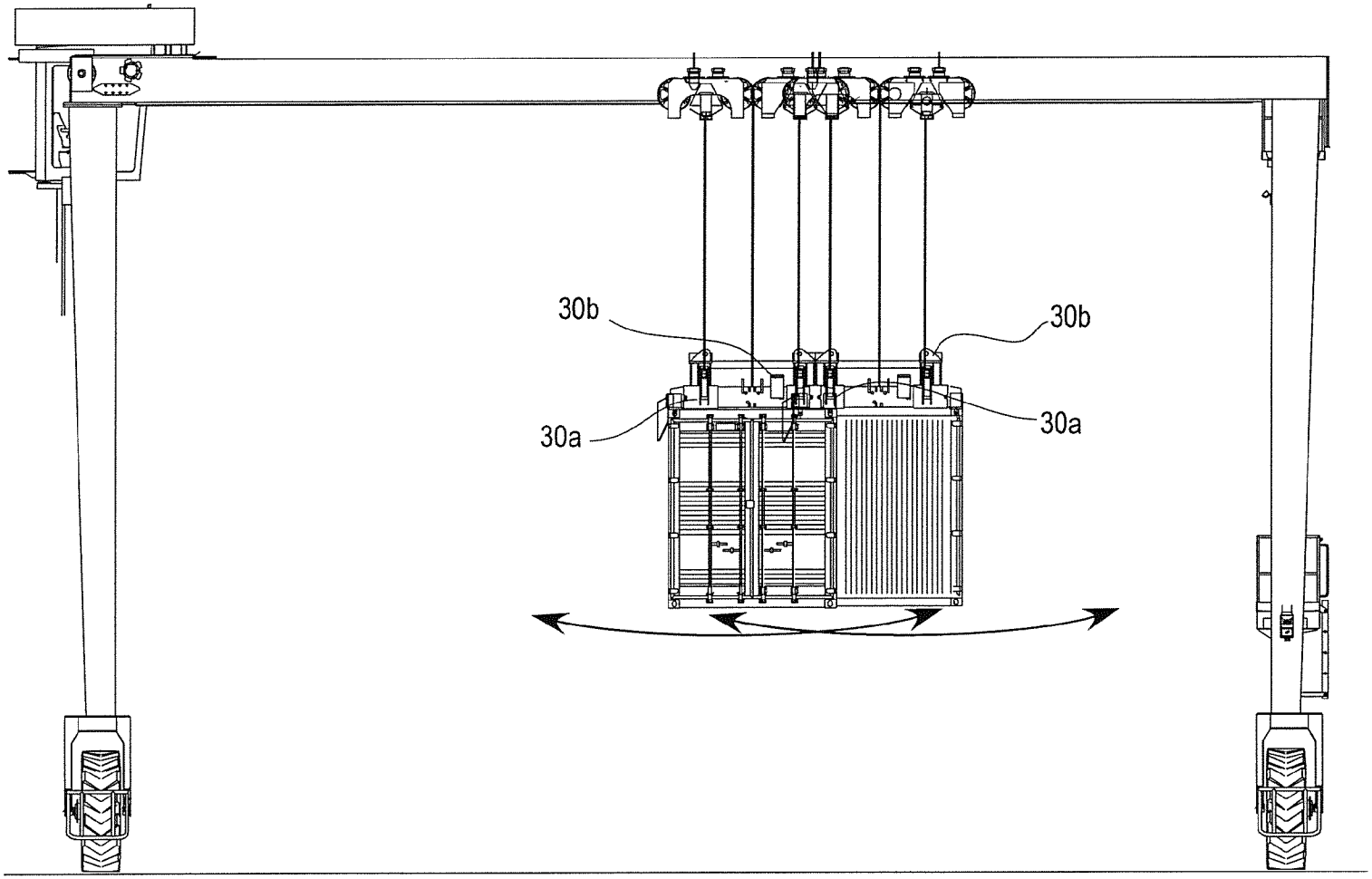
FIG. 3 is a front elevational view of another embodiment of the crane of FIG. 1 with a load attached to multiple hoists suspended from trolleys disposed on the top beams of the crane, illustrating the circular swinging direction of the load when the trolleys are not square with respective to the top beams of the crane.
Figure 3A:
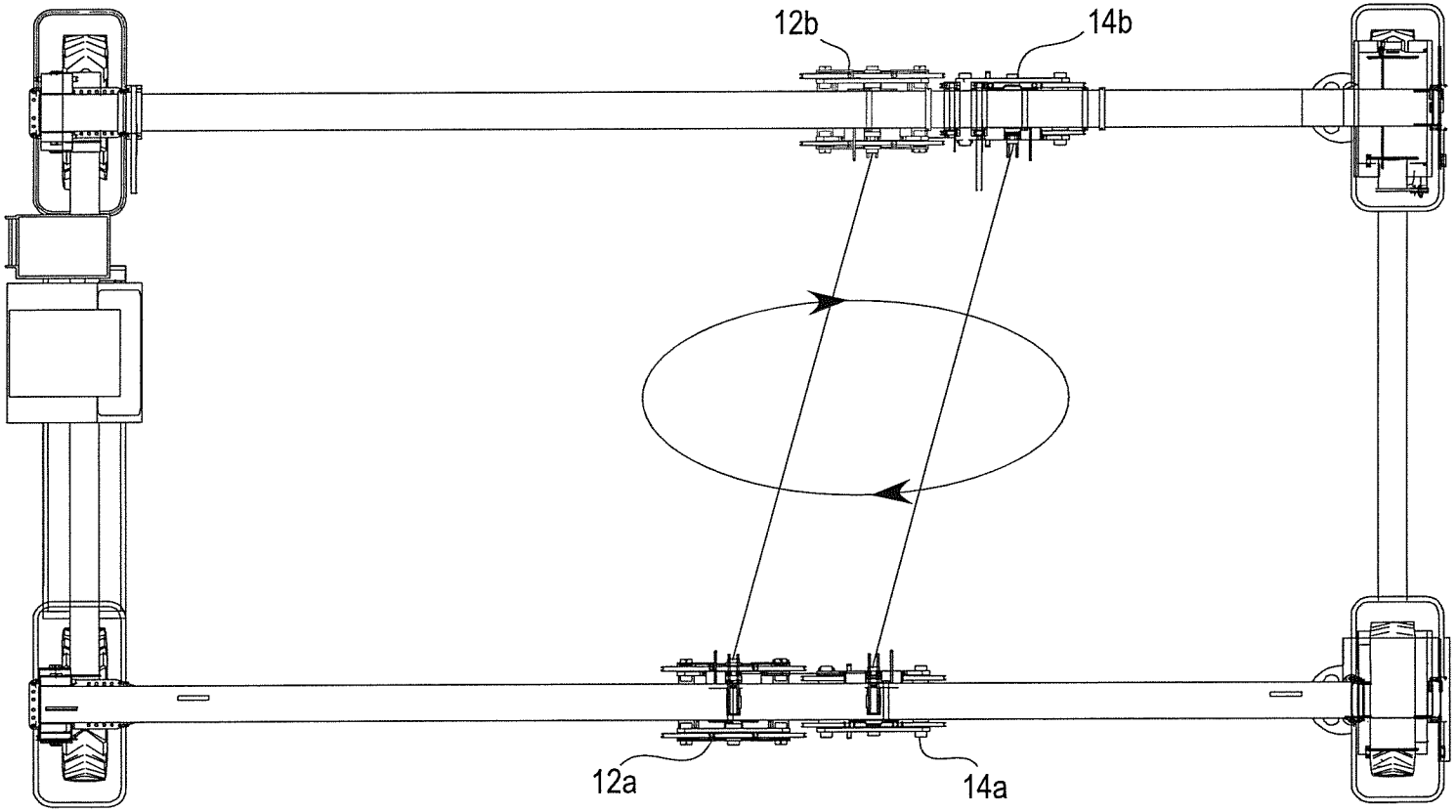
FIG. 3A is a diagrammatic plan view of the crane of FIG. 3, illustrating the swinging direction of the load.
Figure 4:
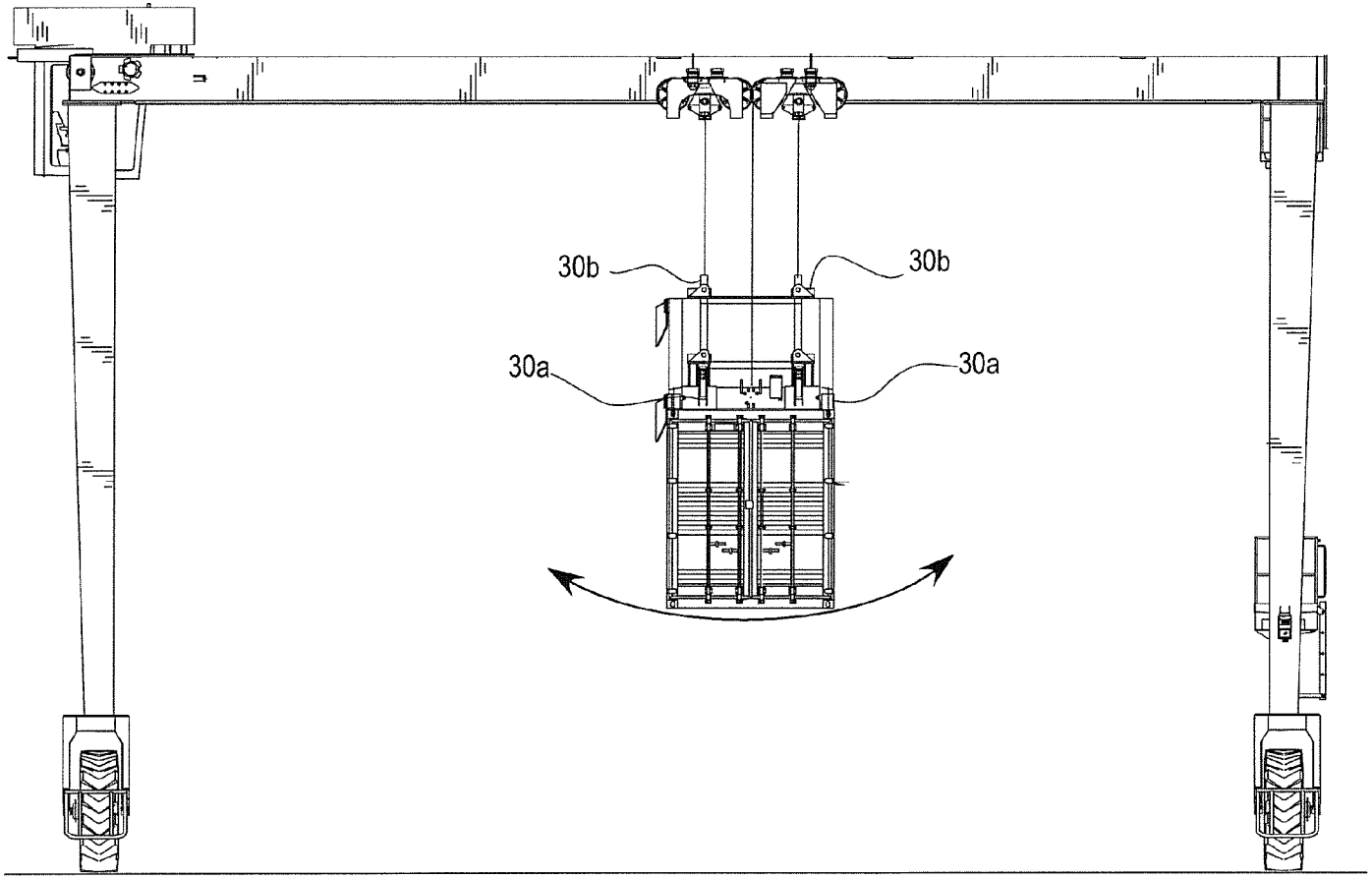
FIG. 4 is a front elevational view of another embodiment of the crane of FIG. 1 with a load attached to multiple hoists suspended from trolleys disposed on the top beams of the crane, illustrating the circular swinging direction of the load when the hoists are not level.
Figure 4A:
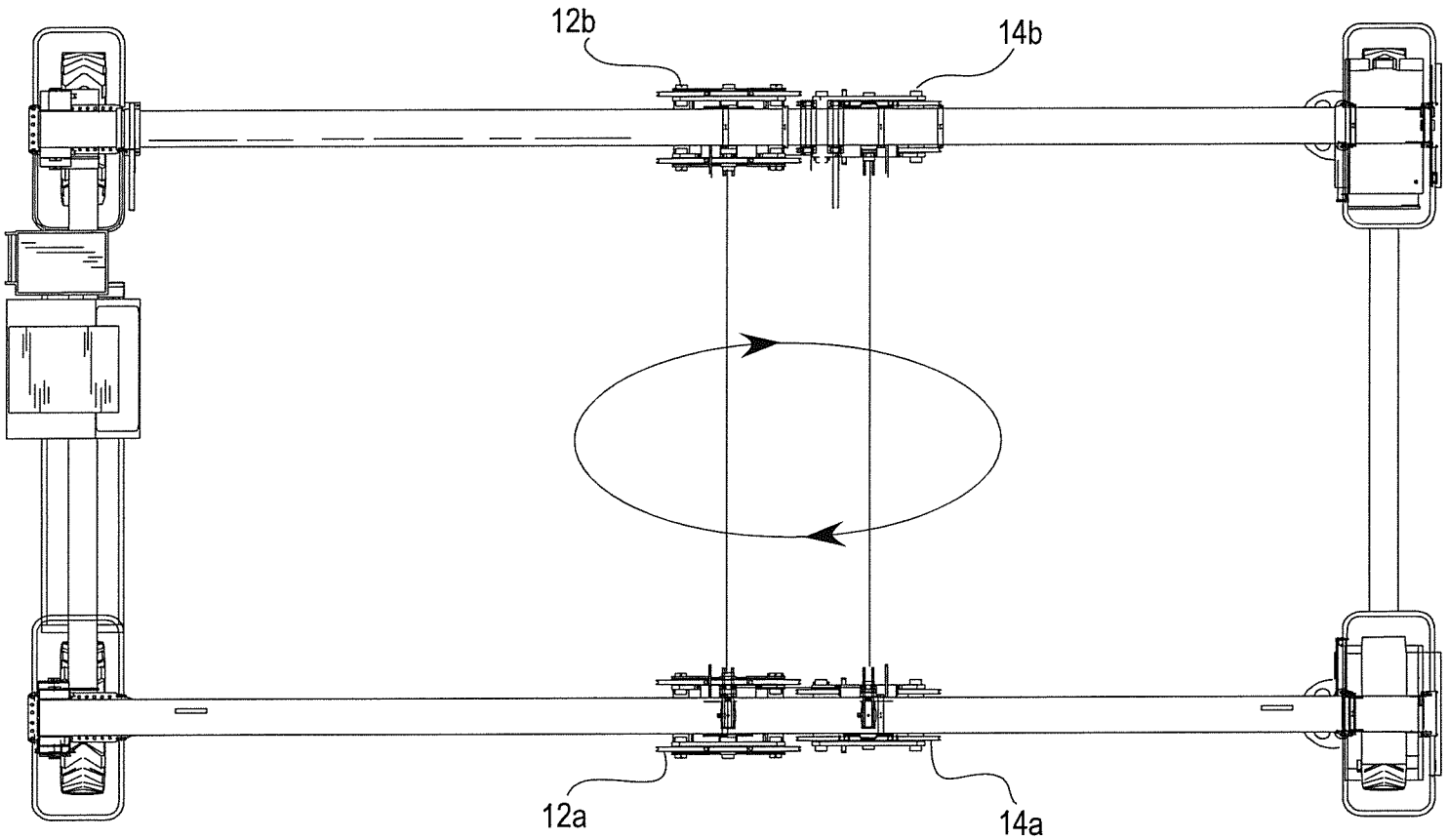
FIG. 4A is a diagrammatic plan view of the crane of FIG. 4, illustrating the swinging direction of the load.

Once synchronization is enabled, at a step 102, the synchronization module 81 of the PLC 80 squares the front and rear trolleys and levels the front and rear hoist members. To square the trolleys, the PLC 80, in the illustrative example, sends a signal to the front trolley actuator 24*a* and the rear trolley actuator 24*b* to move the front trolleys 12*a*, 14*a* along front top beam 20 and the rear trolleys 12*b*, 14*b* along the rear top beam 22 so that front trolleys 12*a*, 14*a* are disposed at the same position on the front top beam 20 as rear trolleys 12*b*, 14*b* are disposed on the rear top beam 22. In the square position, the spreader 36 is perpendicular to the front and rear top beams 20 and 22, respectively (see FIG. 2A). To level the hoist members, the PLC 80 sends a signal to the front and rear hoist actuators 40*a* and 40*b* to move the front and rear hoist members 30*a* and 30*b*, respectively, to a position in which the hook blocks 38*a* of each of the front hoist members 30*a* on the front top beam 20 are level with the hook blocks 38*b* of each of the front hoist members 30*b* on the rear top beam 22, i.e., located at the same vertical distance from the front trolleys 12*a*, 14*a* and the rear trolleys 12*b*, 14*b* (see FIG. 2).

At a step 103, the PLC 80 obtains data regarding the position of the front and rear hoist members 30*a* and 30*b*, the front trolleys 12*a*, 14*a*, and the rear trolleys 12*b*, 14*b* from a monitoring device 84. Based on the data received from the monitoring device 84, the PLC 80 determines when the front and rear hoist members 30*a* and 30*b*, respectively, have been leveled, and the front trolleys 12*a*, 14*a* and the rear trolleys 12*b*, 14*b* have been squared. When that occurs, the hoists and trolleys are in their home or starting position. The PLC 80 then stops movement of the hoists 30*a*, 30*b* and trolleys 12*a*, 12*b*, 14*a*, 14*b*.

The monitoring device 84 may be any device that produces a value that can be used to calculate a position, velocity, and/or acceleration. For example, the monitoring device 84 may be an optical device such as a laser, an inertial measurement device (discussed below), a counting device such as an encoder, tachometer, or resolver, a pulsing device such as a Hall effect sensor or an ultrasonic device, or any other suitable device known in the art. A single monitoring device 84 may be used to monitor all the hoists and trolleys or multiple monitoring devices 84 may be used.

At a step 104, the indicator mechanism 70 is actuated by the PLC 80. The indicator mechanism 70 indicates to an operator that homing is complete and synchronized movement of the load 34 can begin. The indicator mechanism 70 may be a visual, audible, or physical signal. For example, the visual signal may be a flashing light, the audible signal may be a beeping alarm, and the physical signal may be a mechanism that causes vibration of the operator's seat.

At a step 106, movement of either the hoist members 30*a*, 30*b* ("the hoist function") or the trolleys 12*a*, 12*b*, 14*a*, 14*b* ("the trolley function") is selected by an operator. The operator may be a person or a virtual operator such as a computer program. The operator chooses the hoist function by selecting one of the front and rear hoist controls 54*c* and

54*d*, respectively, and chooses the trolley function by selecting one of the front and rear trolley controls 54*a* and 54*b*, respectively.

If the hoist function is selected, then at a step 108 a signal is sent from either the front hoist control 54*c* or the rear hoist control 54*d* to the PLC 80 depending on which control is used by the operator to select the hoist function. In the illustrative example, the front hoist control 54*c* is used to select the hoist function.

At a step 109, the PLC 80 commands the selected hoist control to be a master control and the associated hoist actuator to be a master actuator. The hoist actuator associated with the unselected control then becomes a slave actuator 94. If there are more than two hoist actuators, then the additional hoist actuators also become slave actuators if the hoist control associated with the additional actuators is not selected to be the master control by the operator. In the illustrative example, the front hoist control 54*c* is selected and commanded by the PLC 80 to be the master control and the front hoist actuator 40*a* is commanded to be the master actuator. The rear hoist control 54*d* is then disabled by the PLC 80 and the rear hoist actuator 40*b* is commanded to be the slave actuator. The slave actuator is directed by the master control 90 to move in the same direction and at the same speed as the master actuator. Alternatively, the PLC 80 may enable the rear hoist control 54*d* to be the master control, the rear hoist actuator 40*b* to be the master actuator, and the front hoist actuator 40*a* to be the slave actuator.

If the hoist function is selected, then one of the trolley controls 54*a* or 54*b* is automatically commanded by the PLC 80 to be the master trolley control and the other control to be the slave. The trolley actuator corresponding to the master control will become the master actuator and the trolley actuator corresponding to the slave control will become the slave actuator. Therefore, the trolleys may be moved even if the hoist function has been selected. Likewise if the trolley function is selected as discussed below, one of the hoist controls 54*c* and 54*d* is automatically commanded by the PLC 80 to be the master hoist control and the other to be the slave. The hoist actuator corresponding to the master control will become the master actuator and the hoist actuator corresponding to the slave control will become the slave actuator. Thus, movement of the hoists may occur even if the trolley function has been selected.

If the trolley function is selected, then at a step 110 a signal is sent from either the front trolley control 54*a* or the rear trolley control 54*b* to the PLC 80 depending on which control is used by the operator to select the trolley function. In the illustrative example, the front trolley control 54*a* is used to select the trolley function.

At a step 111, the PLC 80 commands the selected trolley control to be the master control and the associated trolley actuator to be the master actuator. The trolley actuator associated with the unselected control then becomes the slave actuator. If there are more than two trolley actuators, then the additional trolley actuators also become slave actuators if the trolley control associated with the additional actuators is not selected to be the master control by the operator. In the illustrative example, the front trolley control 54*a* is selected and commanded by the PLC 80 to be the master control and the front trolley actuator 24*a* is commanded to be the master actuator. The rear trolley control 54*b* is then disabled by the PLC 80 and the rear trolley actuator 24*b* is commanded by the PLC 80 to be the slave actuator. The slave actuator is directed by the master control to move in the same direction and at the same speed as the master actuator. Alternatively, the PLC 80 may enable the rear trolley control 54*b* to be the master control. The rear trolley actuator 24*b* will then be the master actuator, and the front trolley actuator 24*a* will be the slave actuator.

Figure 6A:
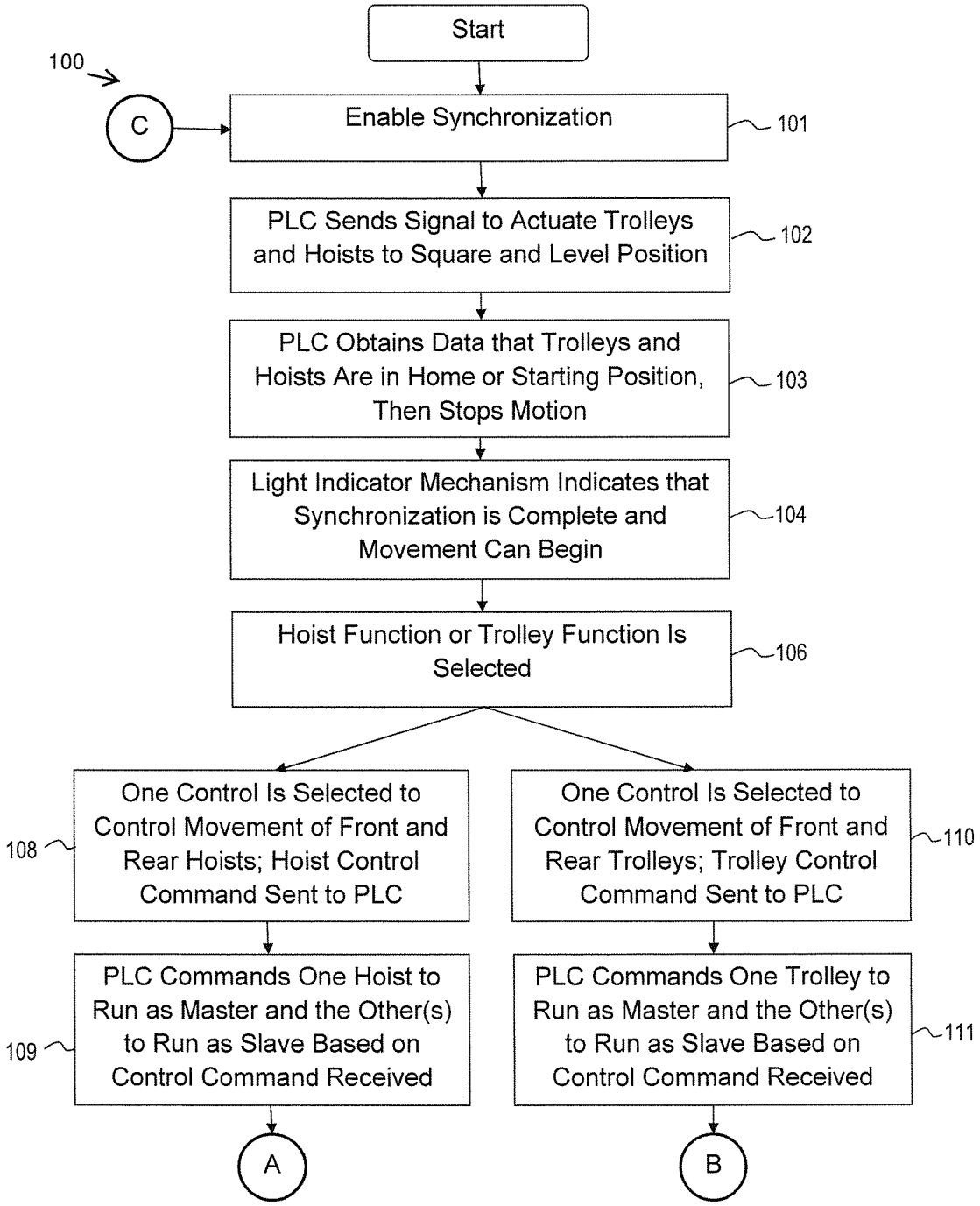
FIGS. 6A and 6B are flow charts illustrating one embodiment of a method of transporting a load.
Figure 6B:
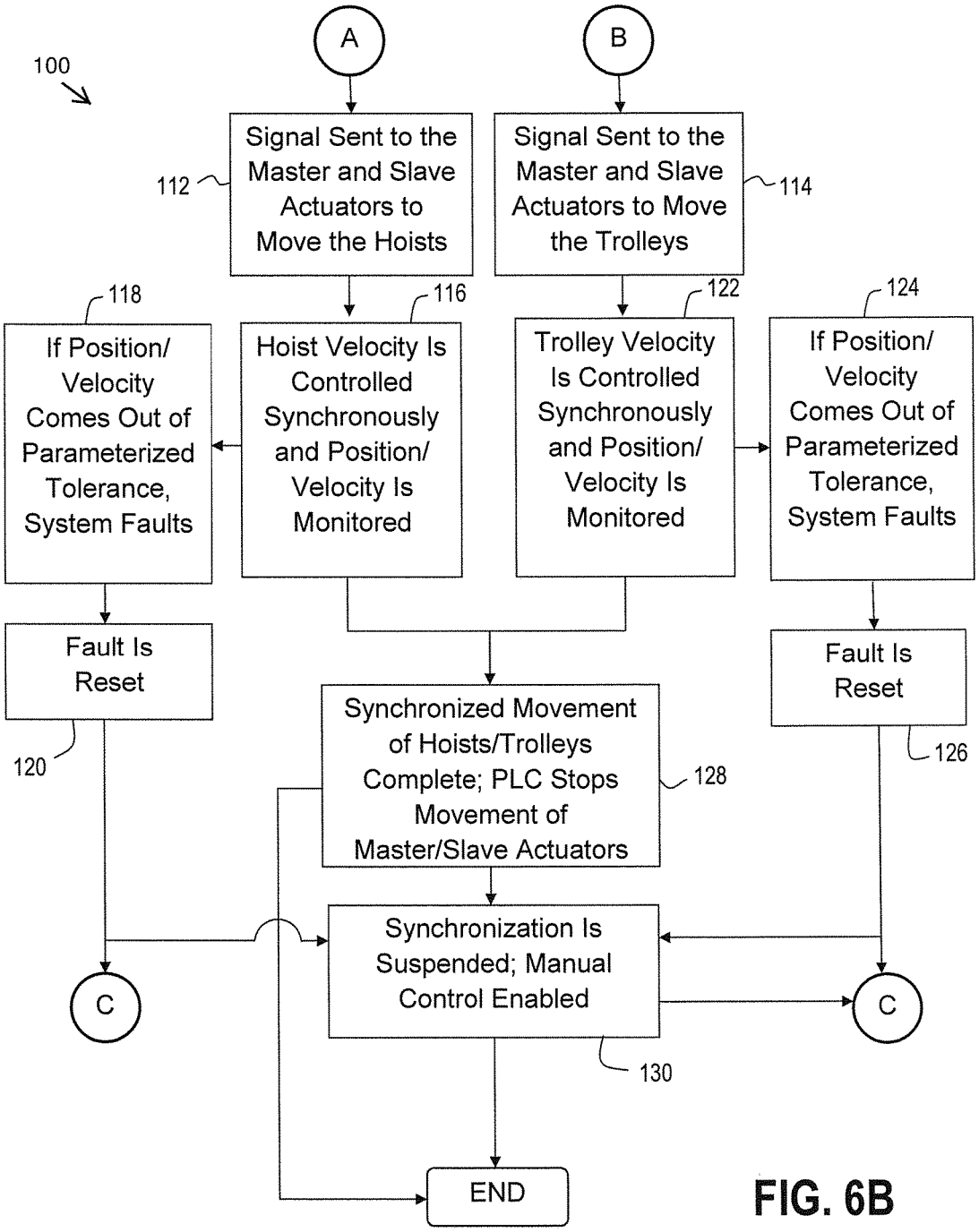
Figure 7A:
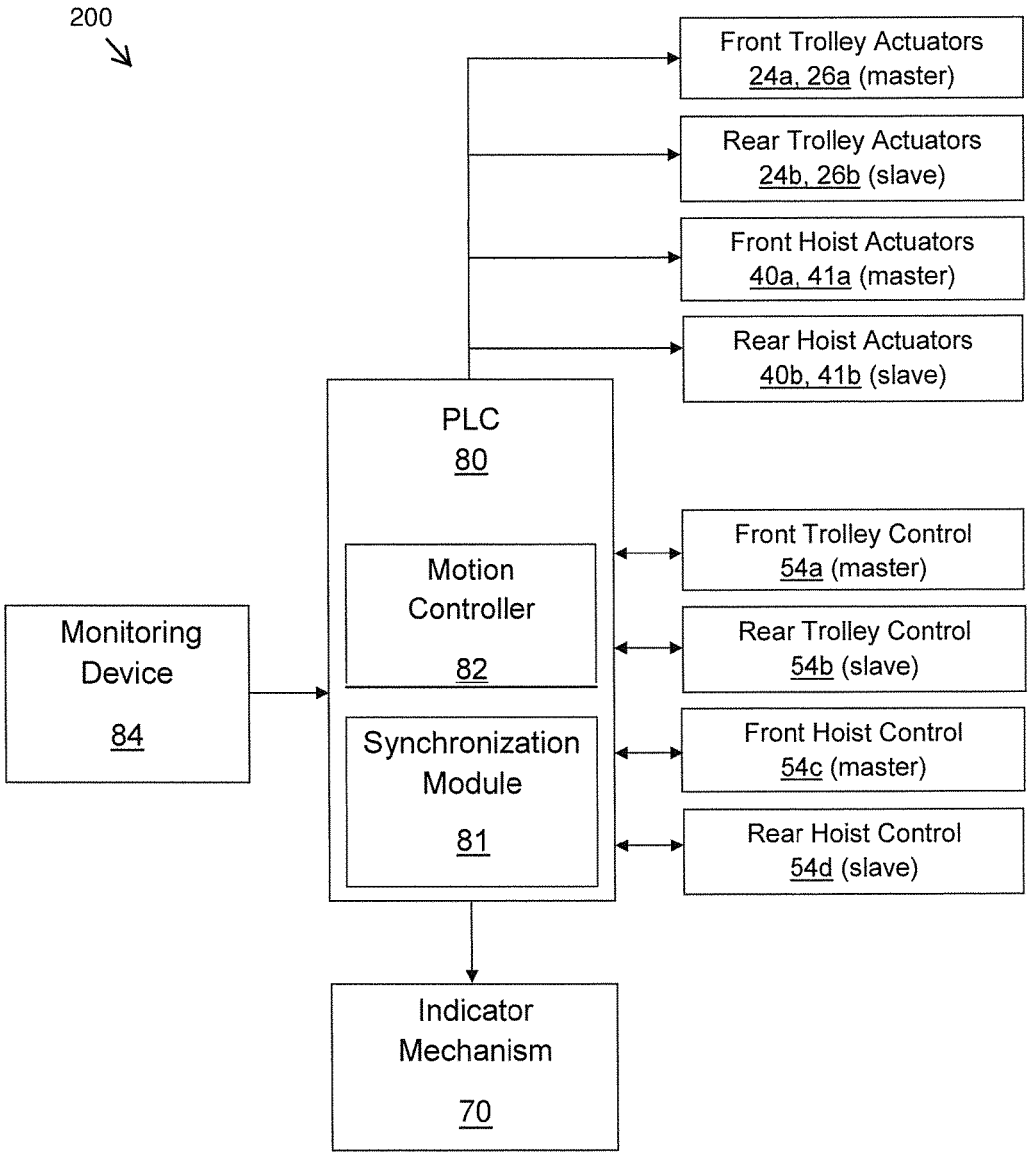
FIG. 7A is a schematic view illustrating one embodiment of a system of transporting a load.
Figure 7B:
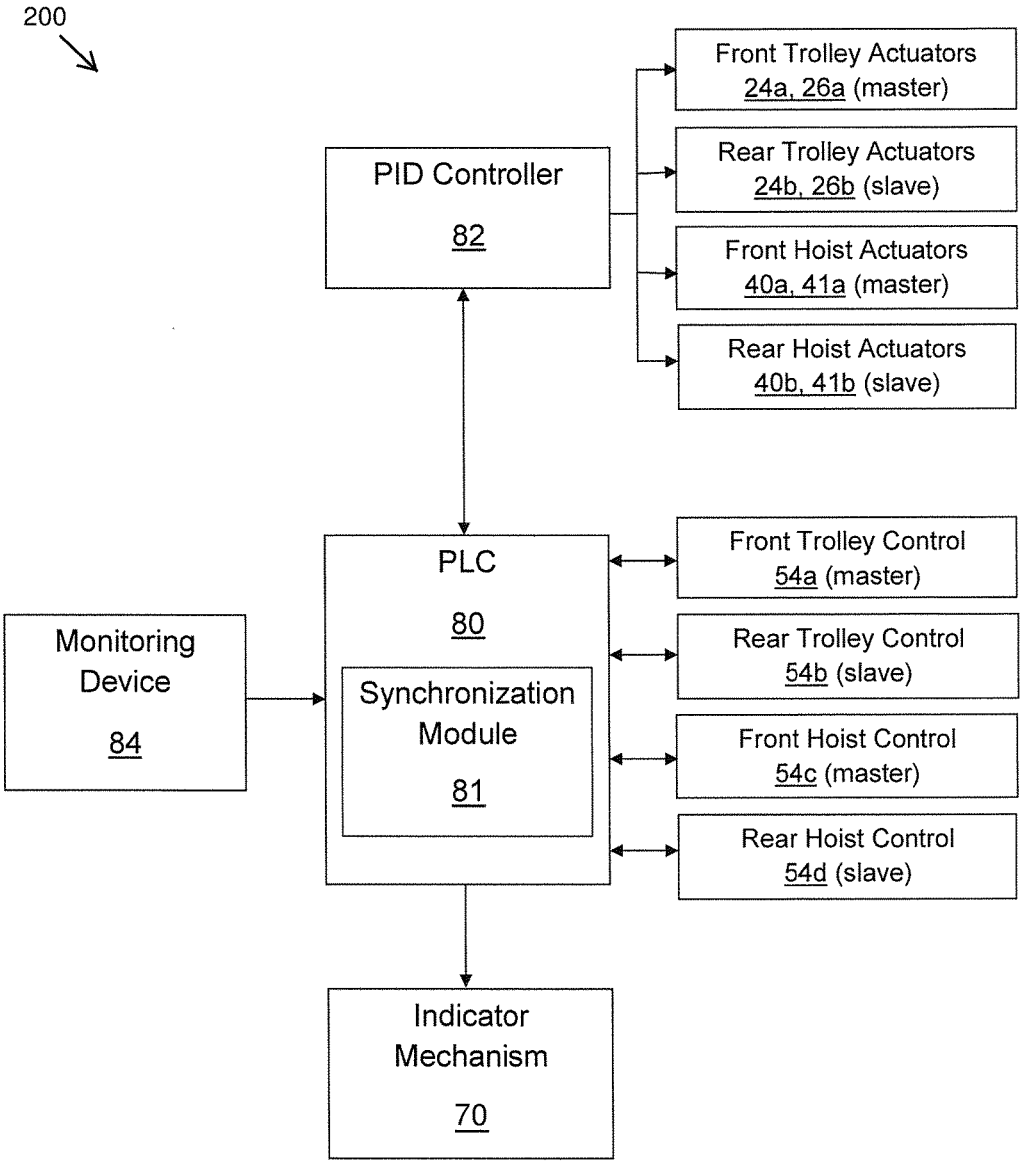
FIG. 7B is a schematic view illustrating another embodiment of a system of transporting a load.

At a step 112 (hoist function) or a step 114 (trolley function), the operator moves the master control 90 to direct the master actuator and the slave actuator to move in a certain direction (see FIG. 6B). Synchronized movement of the master and slave actuators is controlled by a motion controller 82. The motion controller 82 may be a proportional ("P") controller, a proportional-integral ("PI") controller, a proportional-integral-derivative ("PID") controller or any other similar device. A single motion controller 82 may be used (see FIG. 1) or multiple motion controllers 82 may be used. The motion controller 82 may be a function block contained within the PLC 80 (see FIGS. 1 and 7A) or it may be stand alone device that is external to the PLC 80 (see FIG. 1A and FIG. 7B). Because P, PI, and PID controllers are well-known in the art, further detail regarding these devices is not provided herein.

Based on the movement of the master control, a signal is sent to the master and slave actuators to move their associated hoists or trolleys. If the motion controller 82, is a function block within the PLC 80, then the motion controller 82 sends the signal to the master actuator and slave actuator via the PLC 80 (see FIG. 7A). If the motion controller 82 is external to the PLC 80, then the motion controller 82 sends the signal directly to the master actuator and slave actuator (see FIG. 7B). The master actuator moves its associated hoists or trolleys in the direction indicated by the master control. The slave actuator follows the master actuator and moves its associated hoists or trolleys in the same direction and within a parameterized tolerance value (e.g., speed) as the master actuator. For example, if the hoist function has been selected and the front hoist control 54*c* is the master control, then the rear hoist actuator 40*b* is the slave actuator and will move the rear hoist members 30*b* in the same direction and at substantially the same speed that the front hoist (master) actuator 40*a* moves the front hoist members 30*a* in response to the directional signal sent by the master control. This enables the load 34 to be moved in a substantially level manner. Similarly, if the trolley function is selected and the front trolley control 54*a* is the master control, then the rear trolley actuator 24*b* is the slave actuator. The slave actuator moves the rear trolleys 12*b*, 14*b* in the same direction and at substantially the same speed at which the front trolley (master) actuator 24*a* moves the front trolleys 12*a*, 14*a* in response to the directional signal provided by the master control. The load 34 will therefore be moved in a substantially aligned manner along the front and rear top beams 20 and 22, respectively.

If the hoist function has been selected, then at a step 116, the velocity at which each hoist member 30*a*, 30*b* is moving is controlled by the motion controller 82 so that all the hoist members 30*a*, 30*b* are raised or lowered at substantially the same rate. The velocity or position of each hoist member 30*a*, 30*b* is monitored by the monitoring device 84.

The monitoring device 84 monitors the velocity or position of each hoist member 30*a*, 30*b* so that the velocity or position of each hoist member stays within a parameterized tolerance. The monitoring device 84 provides data relating to the speed or position of each hoist member 30*a*, 30*b* to the PLC 80. If the motion controller 82 is a function block within the PLC 80, then the motion controller 82 processes the data from the monitoring device to determine if the speed at which the hoists are moving should be increased or decreased. The motion controller then instructs the PLC 80 to send a signal to the master actuator or slave actuator to increase or decrease the speed of the hoists 30*a*, 30*b*. If the motion controller 82 is external to the PLC 80, the PLC 80 sends the data from the monitoring device 84 to the motion controller 82. The motion controller 82 then processes the data to determine whether the speed at which the hoists 30*a*, 30*b* are being moved should be increased or decreased to keep the speed of all the hoists 30*a*, 30*b* within a parameterized tolerance. The motion controller 82 then sends a signal to the master actuator or slave actuator to increase or decrease the speed of the hoists 30*a*, 30*b*. If the motion controller 82 is external to the PLC 80, the then PLC 80 signals the motion controller 82 to increase or decrease the speed of the hoists 30*a*, 30*b* via the hoist actuators 40*a*, 40*b*.

If the velocity or position of any of the hoists 30*a*, 30*b* falls outside the parameterized tolerance, the PLC 80 stops movement of the hoist members 30*a*, 30*b* directly or through the motion controller 82 and the system faults at a step 118. At step 120, the operator has to reset the fault, at which point the operator can either restart the synchronization process by enabling synchronization at the step 101 or suspend synchronization at a step 130.

If the trolley function has been selected, then at a step 122, the velocity at which each trolley 12*a*, 12*b*, 14*a*, 14*b* is moving is controlled by the motion controller 82 so that all the trolleys are moved laterally along the top beams 20, 22 at substantially the same rate. While the trolleys 12*a*, 12*b*, 14*a*, 14*b* are in motion, the velocity or position of each trolley 12*a*, 12*b*, 14*a*, 14*b* is monitored by the monitoring device 84. The monitoring device 84 provides data to the PLC 80 relating to the speed at which each trolley 12*a*, 12*b*, 14*a*, 14*b* is traveling along the top beams 20, 22. The motion controller 80 processes the data from the monitoring device 84. If the motion controller 82 is a function block within the PLC 80, the motion controller 82 instructs the PLC 80 to send a signal to the master actuator or the slave actuator to either accelerate or decelerate the movement of the trolleys to maintain the speed of all the trolleys 12*a*, 12*b*, 14*a*, 14*b* within a parameterized tolerance. If the motion controller 82 is external to the PLC 80, then the motion controller 82 sends a signal to the master actuator or the slave actuator to either accelerate or decelerate the movement of the trolleys to maintain the speed of all the trolleys 12*a*, 12*b*, 14*a*, 14*b* within a parameterized tolerance. If the velocity or position of any of the trolleys 12*a*, 12*b*, 14*a*, or 14*b* falls outside the tolerance, the PLC 80 stops movement of the trolleys directly or through the motion controller 82 and the system faults at a step 124. At step 126, the operator has to reset the fault, at which point the operator can either restart the synchronization process by enabling synchronization at the step 101 or suspend synchronization at the step 130.

Assuming that the movement of all the hoist members 30*a*, 30*b* or all of the trolleys 12*a*, 12*b* and 14*a*, 14*b* stay within there respective parameterized tolerances, at a step 128 movement of the hoist members 30*a*, 30*b* or trolleys 12*a*, 12*b*, 14*a*, 14*b* will stop when the position at which the operator seeks to move the load 34 is reached. If the load 34 is at its final location, then the method is complete. Alternatively, the operator may choose to suspend synchronization of the hoist members 30*a*, 30*b* and trolleys 12*a*, 12*b*, 14*a*, 14*b* at the step 130 by actuating the suspend button 62, thereby ending the method. At that point, the operator will regain manual control of the hoist members 30*a*, 30*b* and trolleys 12*a*, 12*b*, 14*a*, 14*b*. The operator may then finish movement of the load 34 by manual operation. Alternatively, the operator may restart the synchronization process of the hoist members 30*a*, 30*b* and trolleys 12*a*, 12*b*, 14*a*, 14*b* at step 101.

Figure 8:
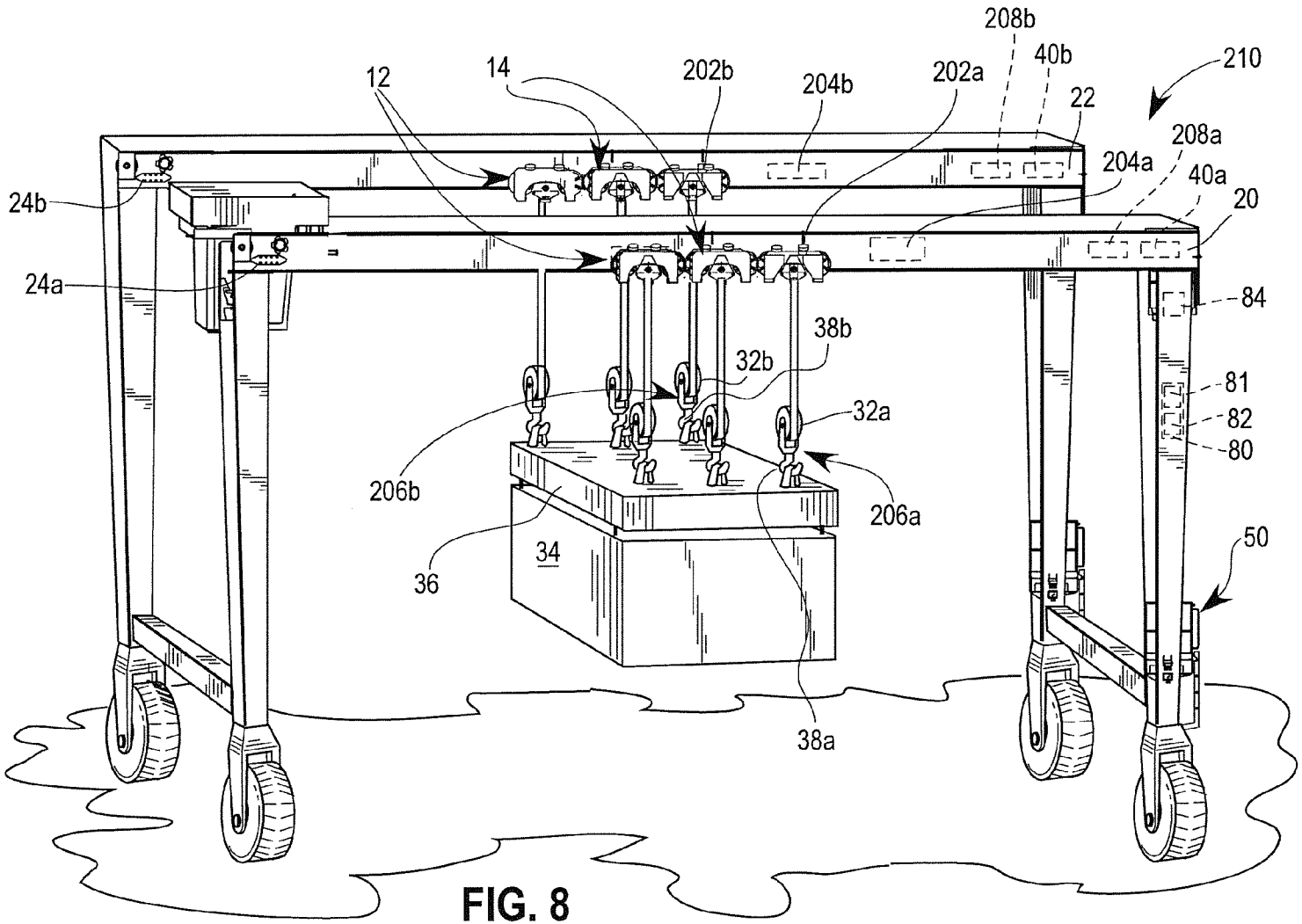
FIG. 8 is a trimetric view of another embodiment of a crane having three trolleys disposed on each top beam.

The above method and system can be used with any type of anti-sway technology and may be used in conjunction with multiple trolleys and hoists on the same beams or a single trolley and hoist on multiple beams. FIG. 8 illustrates another embodiment of a crane 210. The crane 210 is the same as the crane 10 with the exception that it includes a third front trolley 202*a* movably disposed on the front top beam 20 and a third rear trolley 202*b* movably disposed on the rear beam 22. The third front trolley 202*a* may be connected to the front trolley actuator 24*a* or may be connected to a separate front trolley actuator 204*a* as shown in FIG. 8. Similarly, the third rear trolley 202*b* may be connected to the rear trolley actuator 24*b* or may be connected to a separate rear trolley actuator 204*b*. The front trolley actuator 204*a* controls the lateral movement of the third trolley 202*a* along the first top beam 20 of the crane 210. Likewise, the rear trolley actuator 204*b* controls the lateral movement of the third trolley 202*b* along the second top beam 22 of the crane 210.

Attached to the movable front trolley member 202*a* is movable front hoist member 206*a*, and attached to the movable rear trolley member 202*b* is movable rear hoist member 206*b*. The front hoist member 206*a* may be electronically connected to the front hoist actuator 40*a* or may be connected to a separate front hoist actuator 208*a* as shown in FIG. 8. Similarly, the rear hoist member 206*b* may be electronically connected to the rear hoist actuator 40*b* or may be attached to a separate rear hoist actuator 208*b*. The front hoist member 206*a* may also include hoist sheave block 32*a* and hook block 38*a*, and the rear hoist member 206*b* may include hoist sheave block 32*b* and hook block 38*b*.

The front trolley actuator 204*a* is electronically connected to front trolley control 54*a*, and the rear trolley actuator 204*b* is electronically connected to the rear trolley control 54*b*. The front hoist actuator 208*a* is electronically connected to the front hoist control 54*c*, and the rear hoist actuator 208*b* is electronically connected to the rear hoist control 54*d*.

When the method 100 and system 200 described above are used in connection with the crane 210, the third trolley 202*a*, 202*b* and associated hoist member 206*a*, 206*b* operate in the same manner as the front and rear trolleys 12*a*, 14*a* and 12*b*, 14*b*, respectively, and their associated hoist members 30*a*, 30*b*. Thus, the front trolley actuator 204*a* or the rear trolley actuator 204*b* may be the master actuator or a slave actuator, depending on whether the operator selects the trolley function or the hoist function and which control the operator uses to select such functions. Likewise, the front hoist actuator 208*a* or the rear hoist actuator 208*b* may be the master actuator or a slave actuator, depending on whether the operator selects the trolley function or the hoist function and which control the operator uses to select the trolley or hoist function.

In a further embodiment of the method 100 and system 200 described above, a load spreader and one or more Micro Electronic Measurement System ("MEMS") devices may be used. For example, a first MEMS device may be attached to or mounted on the spreader, and a second MEMS device may be attached to or mounted on the trolleys 12*a*, 12*b*, 14*a*, 14*b*. The MEMS device may, include, for example, an Inertial Measurement Unit ("IMU") device, an accelerometer, a gyroscope, or the like. The first MEMS device may measure, for example, the acceleration of the spreader alone or in combination with a load. The MEMS IMU device may measure, for example, the acceleration of the trolleys along the beams. The measurements obtained by the MEMS devices may then be sent to the PLC 80. Depending on the whether the measurement falls within or outside a parameterized tolerance, the motion controller 82 may increase or decrease the speed at which the trolley actuators 24*a*, 24*b* are moving the trolleys 12*a*, 12*b*, 14*a*, 14*b* or the speed at which the hoist actuators 40*a*, 40*b* are moving the hoist members 30*a*, 30*b*.

In another embodiment of the method 100 and system 200 described above, the trolley actuators 24*a*, 24*b* and the hoist actuators 40*a*, 40*b* are hydraulic valves. In this embodiment, a valve controller is connected to each of the trolley and hoist actuators. Each of the valve controllers includes a motion controller 82 such as a PID. The PLC 80 sends the valve controllers a signal to move the trolleys or hoists. Movement of the trolleys or hoists is effectuated by increasing or decreasing the flow of fluid through a valve associated with each actuator. The flow of fluid through the valve is controlled by a valve spool; opening the valve spool increases the flow of fluid through the valve, which increases the speed of the trolleys or hoists and closing the valve spool decreases the flow of fluid through the valve, which decreases the speed of the trolleys or hoists. The valve controller uses the motion controller 82 to monitor the valve spool position and to determine if the trolleys or hoists are staying within a parameterized tolerance. The valve controller adjusts the actual valve spool (i.e., opens or closes the valve spool) to control flow through the actuator valve to stay within the parameterized tolerance. If the speed at which the trolleys or hoists are moving comes out of the parameterized tolerance, then the system faults as discussed above with respect to method 100.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A method of transferring a load using a transport device, the transport device having a first hoist and a second hoist and a first trolley and a second trolley, wherein the first hoist is connected to the first trolley and the second hoist is connected to the second trolley, the method comprising the steps of:

enabling synchronization of the first and second hoists and the first and second trolleys, wherein synchronization includes the steps of:

leveling the first and second hoists; and squaring the first and second trolleys;

choosing one of a hoist function and a trolley function, wherein the first and second hoists are a first mover and a second mover, respectively, if the hoist function is selected, and wherein the first and second trolleys are the first and second movers, respectively, if the trolley function is selected;

commanding one of the first mover and the second mover to be a master and the other mover to be a slave, wherein the master is connected to a first actuator and the slave is connected to a second actuator;

actuating a master control associated with the master; and outputting a signal to the first and second actuators, whereby the first actuator moves the master and the second actuator moves the slave in a direction indicated by the master control.

2. The method of claim 1, the transport device further including a program logic controller electronically connected to the master control.

3. The method of claim 2, wherein the program logic controller outputs the signal to the first and second actuators.

4. The method of claim 2, the transport device further including a motion controller that is separate from but electronically connected to the program logic controller, wherein the motion controller outputs the signal to the first and second actuators.

5. The method of claim 4, wherein the signal is transmitted to the motion controller via the program logic controller.

6. The method of claim 2, further including the steps of:

monitoring one of the velocity and the position of the master and the slave with a monitoring device;

providing feedback regarding one of the velocity and the position of the master and the slave to the program logic controller; and determining if one of the velocity and the position of the master and the slave are within a parameterized tolerance.

7. The method of claim 6, wherein the monitoring device is any one of an encoder, tachometer, resolver, laser, Hall effect sensor, ultrasonic device, gyroscope, and accelerometer or any combination thereof.

8. The method of claim 6, whereby the step of enabling is repeated if one of the velocity and position of one of the master and the slave is not within the parameterized tolerance.

9. The method of claim 1, further including the step of attaching the first and second hoists to the load, such that the load can be moved in a substantially vertical direction by the first and second hoists and a substantially lateral direction by the first and second trolleys.

10. The method of claim 1, further including the step of actuating an indicator mechanism when synchronization is complete.

11. The method of claim 1, further including the step of suspending synchronization.

* * * * *